United States Patent [19]

Abe

[11] Patent Number: 5,066,262

[45] Date of Patent: Nov. 19, 1991

[54] COIN DISPENSING APPARATUS

[75] Inventor: Hiroshi Abe, Tokyo, Japan

[73] Assignee: Asahi Seiko Kabushiki Kaisha, Tokyo, Japan

[21] Appl. No.: 589,059

[22] Filed: Sep. 27, 1990

[30] Foreign Application Priority Data

| | | | |
|---|---|---|---|
| Oct. 3, 1989 | [JP] | Japan | 1-115854[U] |
| Jun. 13, 1990 | [JP] | Japan | 1-61751[U] |
| Aug. 2, 1990 | [JP] | Japan | 1-81727[U] |

[51] Int. Cl.[5] ..... G07D 1/00

[52] U.S. Cl. ..... 453/57; 221/182

[58] Field of Search ..... 453/32, 49, 57; 221/182, 203

[56] References Cited

U.S. PATENT DOCUMENTS

| | | | |
|---|---|---|---|
| 1,130,898 | 3/1915 | Havener | 221/182 X |
| 2,433,561 | 12/1947 | Angell | 221/182 X |
| 3,273,571 | 9/1966 | Seiden | 453/57 X |
| 3,788,334 | 1/1974 | Saraceno et al. | 221/182 X |
| 3,933,162 | 1/1976 | Smith | 453/57 |
| 3,942,544 | 3/1976 | Breitenstein et al. | 453/57 X |
| 4,518,001 | 5/1985 | Branham | 453/49 |
| 4,541,444 | 9/1985 | Okada | 453/57 X |
| 4,589,433 | 5/1986 | Abe | 221/203 X |
| 4,598,724 | 7/1986 | Boland | 453/57 X |
| 4,615,350 | 10/1986 | Boudville | 453/57 |

*Primary Examiner*—Frank E. Werner
*Assistant Examiner*—Scott L. Lowe
*Attorney, Agent, or Firm*—Nilles & Nilles

[57] ABSTRACT

A coin dispensing apparatus comprises a hopper mounted on a supporting plate inclined to the horizontal for holding a supply of coins, and a rotary disc rotatably supported on the supporting plate within the hopper, the rotary disc has at the central portion a central shelf of a diameter depending on a diameter of a coin to be dispensed and has at the peripheral portion a plurality of coin feeding pins spaced in the peripheral direction, the peripheral portion of the rotary disc is provided with a plurality of inclined grooves each extending substantially in a direction tangential to the periphery of the central shelf between the sequential feeding pins, and at least one of the grooves is embedded with friction material such as rubber.

5 Claims, 4 Drawing Sheets

COIN DISPENSING APPARATUS

BACKGROUND OF THE INVENTION

1. Field of the Invention

The present invention relates to a pin type coin dispensing apparatus used in a coin changer, game machine or the like for dispensing desired quantities of coins or tokens one at a time from a hopper storing them in bulk by means of a rotary disc having a plurality of coin feeding pins.

2. Description of the Prior Art

Hitherto, such a coin dispensing apparatus is well known as disclosed in U.S. Pat. No. 4589433 and comprises, as shown in FIG. 10, a hopper 1 for storing coins to be dispensed in bulk and a rotary disc 2 disposed in the hopper 1 and rotatably supported on an inclined support plate 3 by means of a bearing (not shown) to be rotated about a rotating shaft 4 at an angle to the horizontal within the hopper 1. The rotary disc has at its central portion a central shelf 5 of a diameter depending on a diameter of a coin to be dispensed and at its peripheral portion 2-1 a plurality of coin feeding projections or pins 6 spaced in the peripheral direction to define coin receiving spaces on an inclined surface of the rotary disc 2 between sequential feeding pins 6. When the rotary disc 2 is rotated, each coin feeding pin 6 picks up a coin into the respective coin receiving space from a gutter (not shown) formed between lower portions 1*a* and 2*a* of the hopper 1 and the rotary disc 2 and delivers the coin to the upper delivery zone 2-2. At this upper delivery zone, each coin is pushed into a discharge chute along a delivery guide 7 by the respective coin feeding pin 6, the delivery guide 7 is extended in a direction tangential to the upper periphery of the central shelf 5 and traverses the peripheral portion 2-1 of the rotary disc 2.

Such a conventional coin dispensing apparatus has a problem that coins can not be discharged from the hopper in spite of a number of coins to be dispensed being stored in the hopper especially when large coins having a large diameter and thickness such as one dollar coins having a diameter of 38 mm or five dollar coins having a diameter of 45 mm are stored in the hopper, since at least three stacks of coins (A) are formed at the lower end on the surface of inclined bottom 1*b* of the hopper 1 in such a ballanced or stable condition as shown in FIG. 10 so that each coin A in the stacks contacts at its peripheral edge with the surface of the rotary disc 2 and slips on the surface or rotates about a vertical axis of the stack when the rotary disc is rotated and consequently coins in the hopper can not slip down into the gutter.

SUMMARY OF THE INVENTION

The object of the present invention is to solve the aforementioned problem by preventing the stacks of coins from forming at the lower end on the bottom surface of the hopper to thereby improve dispensing efficiency of the pin type coin dispensing apparatus.

According to the present invention, a coin dispensing apparatus comprises a supporting plate inclined to the horizontal, a hopper mounted on the supporting plate for holding a supply of coins, and a rotary disc rotatably supported on the supporting plate within the hopper, the rotary disc has at the central portion a central shelf of a diameter depending on a diameter of a coin to be dispensed and has at the peripheral portion a plurality of coin feeding pins spaced in the peripheral direction, the hopper has an inclined bottom surface extending towards the lower peripheral portion of the rotary disc and a gutter forming lower portion connected to the lower end of the inclined bottom surface thereof, and the peripheral portion of the rotary disc is provided with a plurality of inclined grooves each extending substantially in a direction tangential to the periphery of the central shelf between the sequential feeding pins.

It is advantageous to embed friction material such as rubber in at least one of the grooves.

It is preferable to provide the groove in the shape of an angle extending over a coin feeding pin.

Furthermore it is preferable to provide at least two ridges spaced parallel to each other with a distance smaller than a diameter of a coin to be dispensed and extending on the bottom surface of the hopper towards the lower peripheral portion of the rotary disc.

DESCRIPTION OF THE DRAWINGS

Further objects and advantages of the invention will become apparent as the following description of an illustrative embodiment proceeds with reference to the drawings in which.

DESCRIPTION OF THE PREFERRED EMBODIMENTS

Figure 1:
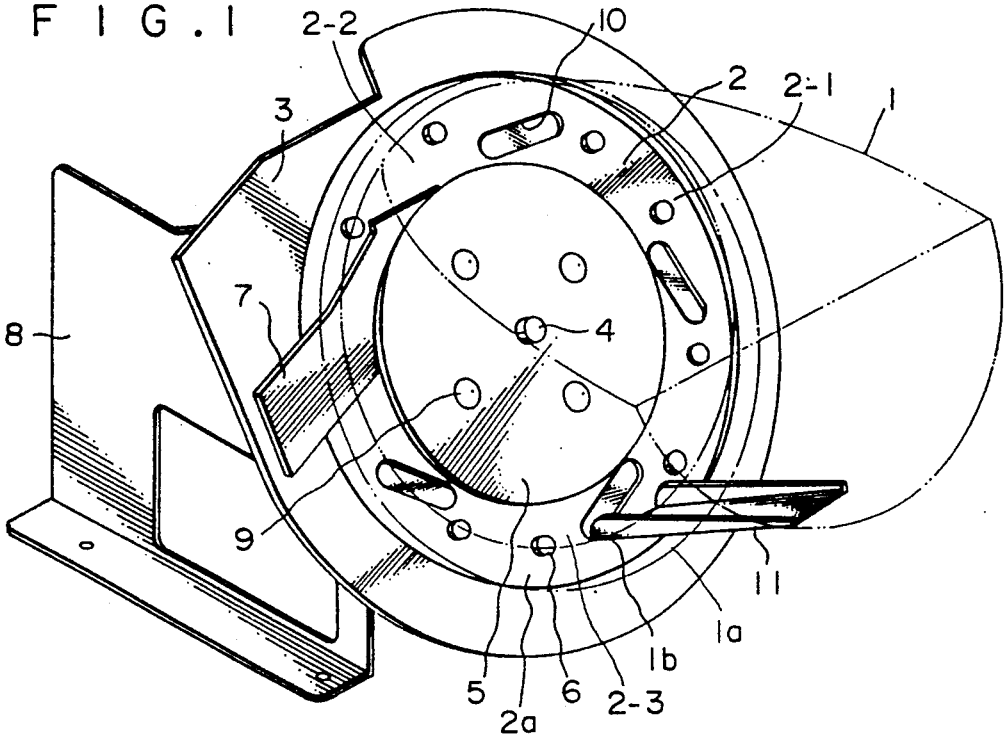
FIG. 1 is a schematic perspective view of the coin dispensing apparatus according to the present invention.
Figure 2:
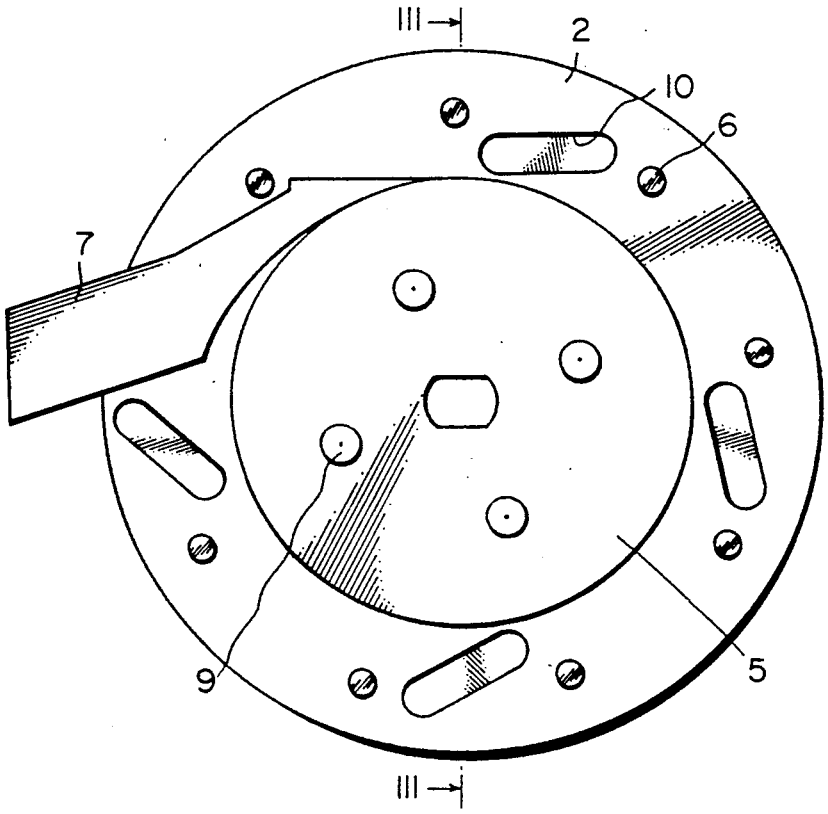
FIG. 2 is a front view of the rotary disc shown in FIG. 1.
Figure 3:
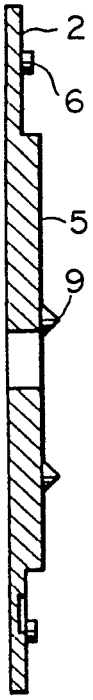
FIG. 3 is a sectional view taken along a line III—III in FIG. 3.
Figure 4:
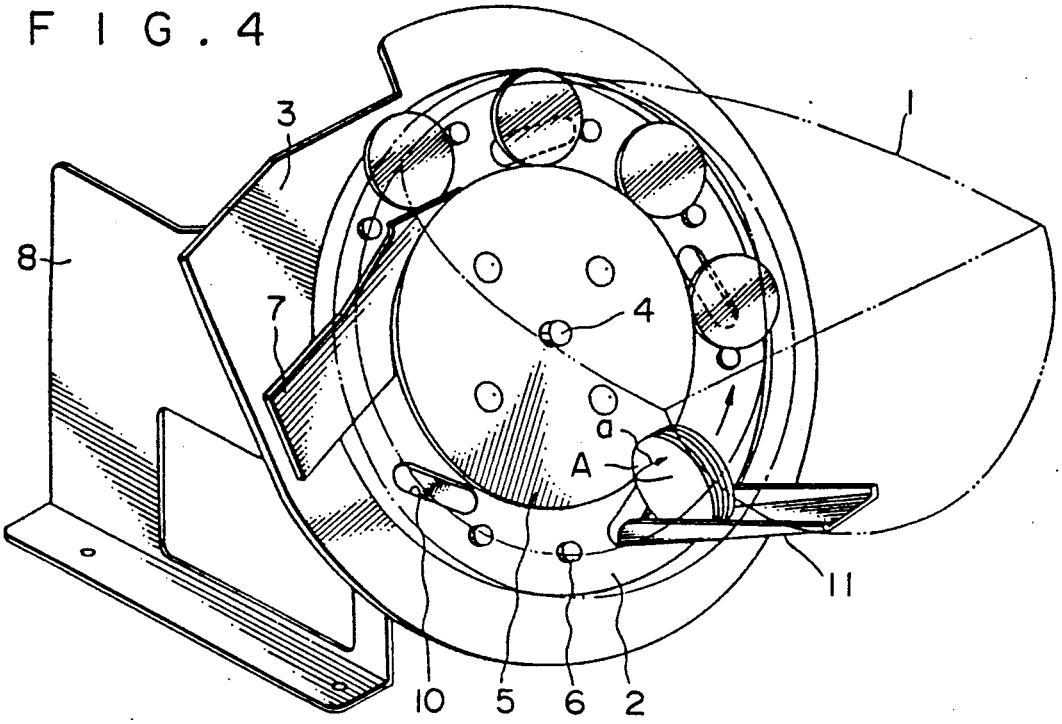
FIG. 4 is a perspective view similar to FIG. 1 showing a function of grooves and ridges.

Referring to FIGS. 1–4 showing an embodiment of the present invention, a hopper 1 for storing a number of coins to be dispensed in bulk is mounted on a supporting plate 3 inclined to the horizontal and supported by a stand 8. A rotary disc 2 is rotatably supported on the supporting plate 3 by means of a thrust bearing (not shown) to position at a side within the hopper 1 and is drivingly connected to a driving shaft 4 to rotate in an inclined position within the hopper 1.

The rotary disc 2 has a central shelf 5 of a diameter depending on a diameter of a coin to be dispensed at the central portion of the rotary disc and a plurality of coin feeding pins 6 in the peripheral portion 2-1 around the central shelf 5. The coin feeding pins 6 are spaced in the peripheral direction with a distance larger than a diameter of the coin to be dispensed.

Thus, when the rotary disc 2 is rotated, each coin feeding pin 6 picks up a coin from a gutter (not shown) formed between lower portions 1*a* and 2*a* of the hopper 1 and the rotary disc 2 and delivers the coin to an upper delivery zone 2-2. Each coin is discharged through a discharge chute (not shown) along a delivery guide 7 which is extended in a direction tangential to the upper periphery of the central shelf 5 and traverses the peripheral portion 2-1 of the rotary disc. The central shelf 5 is provided with a plurality of agitator pins 9.

Referring to FIG. 1, the peripheral portion of the rotary disc 2 is provided with a plurality of inclined grooves 10 between the sequential feeding pins. Each of the grooves extends substantially in a direction tangential to the periphery of the central shelf 5. The hopper 1 is provided with two ridges 11 spaced parallel to each other with a distance smaller than a diameter of a coin to be dispensed at the lower end of the bottom 1*b* of the hopper 1. The ridges 11 are extended on the bottom surface of the hopper towards the lower peripheral portion 2-3 of the rotary disc 2.

In accordance with the aforementioned arrangement, when the rotary disc 2 is rotated, a coin which a peripheral edge contacts with the lower peripheral portion of the rotary disc 2 is engaged with the groove 10 and rotated about its center as shown by an arrow "a" to change a posture so as to direct in a direction parallel to the surface of the rotary disc 2. Consequently, the coin drops into the gutter so that the coin can be picked up by the coin feeding pin 6 and transferred to the upper delivery zone 2-2.

The ridges 11 on the bottom surface of the hopper 1 effects to prevent the coins forming a stable set of at least three stacks of coins at the bottom of the hopper 1.

Figure 5:
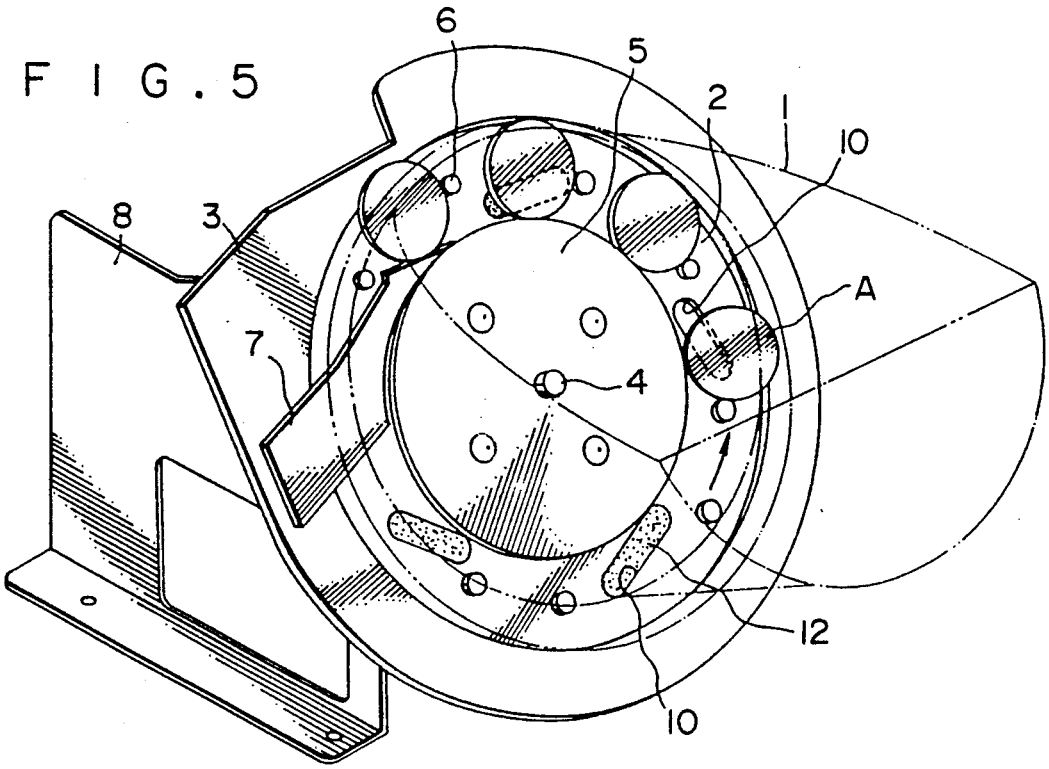
FIG. 5 is a schematic perspective view illustrating an advantageous embodiment of FIG. 1.
Figure 6:
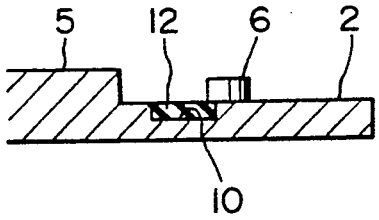
FIG. 6 is a partial sectional view of the rotary disc shown in FIG. 5.

Referring to FIG. 5, a friction material 12 such as rubber may be embedded in at least one of the grooves 10 to effect a frictional engagement with the coin.

Figure 7:
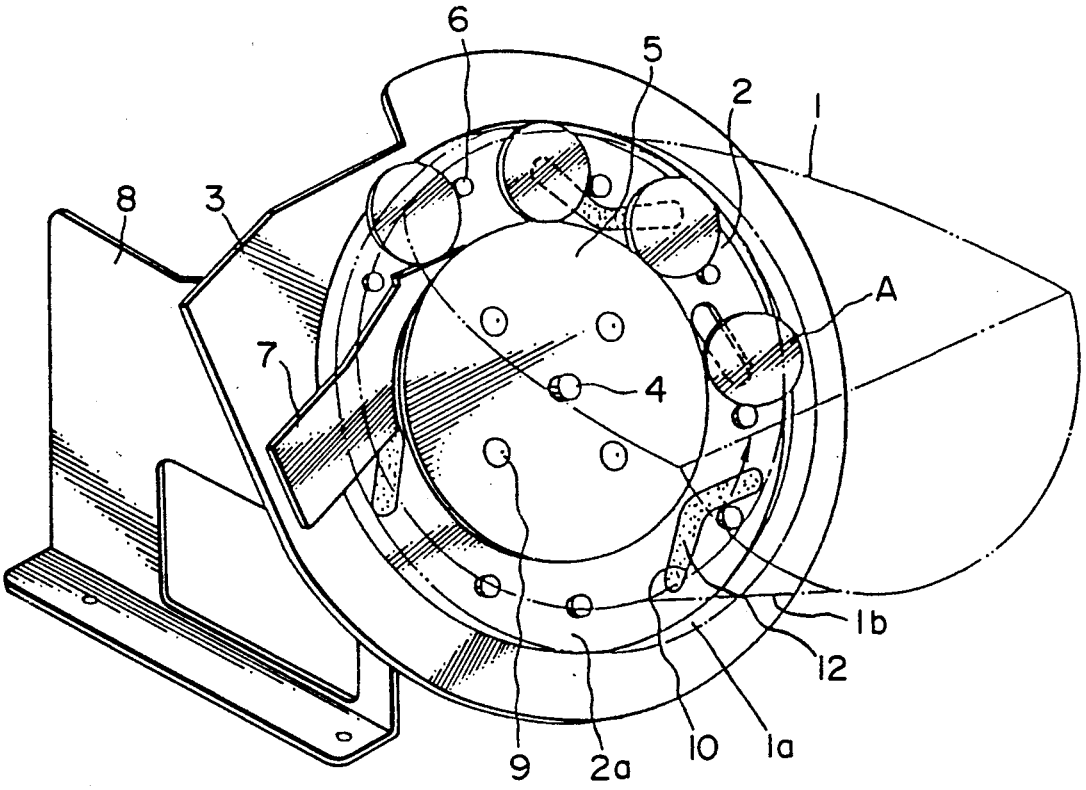
FIG. 7 is a schematic perspective view illustrating another embodiment of the present invention.
Figure 8:
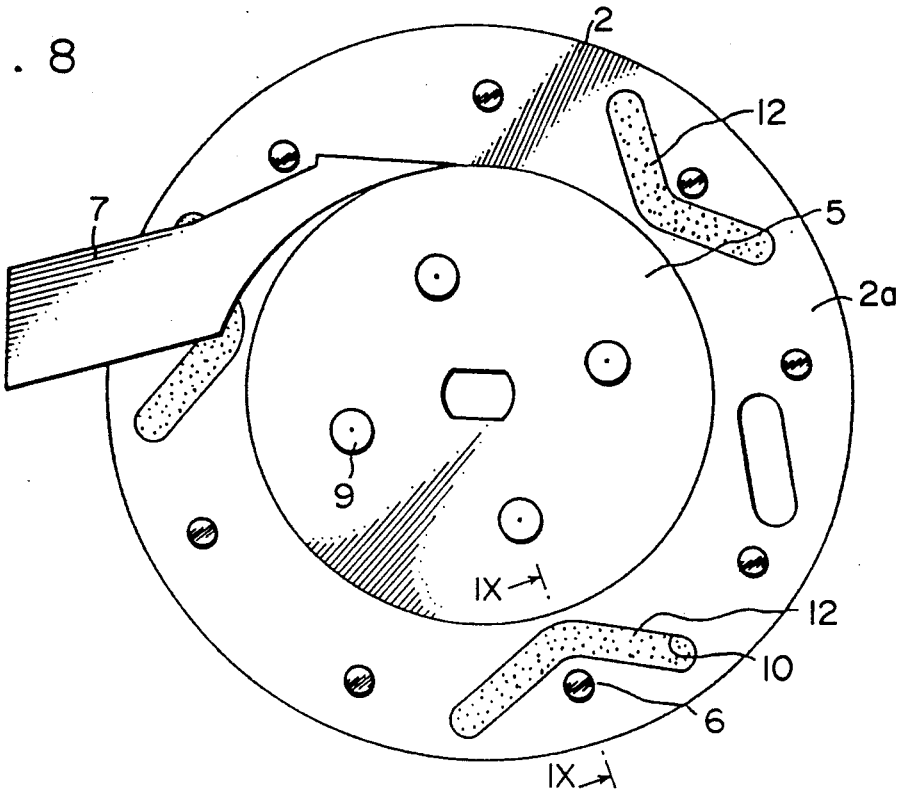
FIG. 8 is a front view of the rotary disc shown in FIG. 7.
Figure 9:
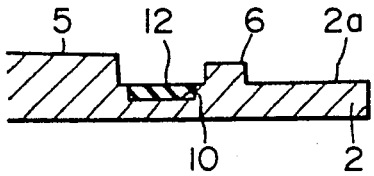
FIG. 9 is a partial sectional view taken along a line IX—IX of the rotary disc shown in FIG. 8.
Figure 10:
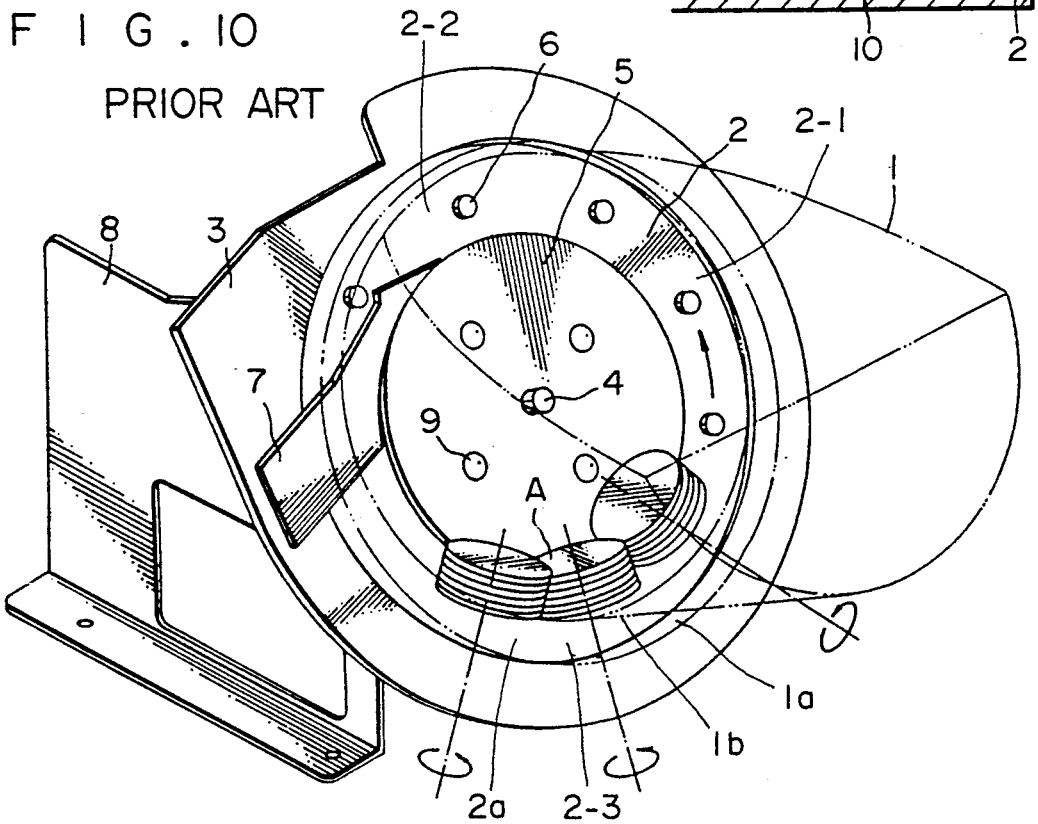
FIG. 10 PRIOR ART
FIG. 10 is a schematic perspective view of a conventional pin type coin dispensing apparatus.

FIGS. 7-9 shown another embodiment of the present invention. In this embodiment, grooves 10 are provided at the peripheral portion 2-1 of the rotary disc 1 in the shape of an angle. The groove 10 may be extended over the coin feeding pin 6 and embedded with the friction material 12.

What is claimed is:

1. A coin dispensing apparatus comprising a supporting plate inclined to the horizontal, a hopper mounted on the supporting plate for holding a supply of coins, a rotary disc rotatably supported on the supporting plate within the hopper, the rotary disc having a circular central shelf in the center thereof of a diameter depending on a diameter of a coin to be dispensed and having a plurality of sequential feeding pins spaced along the peripheral portion thereof, the hopper having an inclined bottom surface extending towards a lower peripheral portion of the rotary disc and a gutter forming lower portion connected to a lower end of the inclined bottom surface, and the peripheral portion of the rotary disc being provided with a plurality of inclined grooves inset into the rotary disc, each extending substantially in a direction tangential to the periphery of the circular central shelf and being between the sequential feeding pins.

2. An apparatus claimed in claim 1, wherein a frictional material is embedded in at least one of the inset grooves.

3. An apparatus claimed in claim 1, wherein the groove is in the shape of an angle extending over a coin feeding pin.

4. An apparatus claimed in claim 3, wherein a frictional material is embedded in at least one of the inset grooves.

5. An apparatus claimed in claim 1, wherein at least two ridges are provided and are spaced parallel to each other with a distance smaller than a diameter of a coin to be dispensed and extending on the bottom surface of the hopper towards the lower peripheral portion of the rotary disc.

* * * * *